US008375520B2

(12) United States Patent
Roy

(10) Patent No.: US 8,375,520 B2
(45) Date of Patent: Feb. 19, 2013

(54) BACK CLOSURE

(75) Inventor: Armand E Roy, Attleboro, MA (US)

(73) Assignee: Craft, Inc. a Massachusettes Corporation, South Attleboro, MA (US)

( * ) Notice: Subject to any disclaimer, the term of this patent is extended or adjusted under 35 U.S.C. 154(b) by 435 days.

(21) Appl. No.: 12/578,546

(22) Filed: Oct. 13, 2009

(65) Prior Publication Data

US 2010/0088849 A1 Apr. 15, 2010

Related U.S. Application Data

(60) Provisional application No. 61/105,193, filed on Oct. 14, 2008.

(51) Int. Cl.
*E05D 11/06* (2006.01)

(52) U.S. Cl. ..... 16/388; 16/223; 16/374; 40/748

(58) Field of Classification Search ..... 16/374, 16/233, 387, 335, 297, 333, 376, 382, 355, 16/DIG. 29, 388, 223; 40/748, 754
See application file for complete search history.

(56) References Cited

U.S. PATENT DOCUMENTS

| | | | | | |
|---|---|---|---|---|---|
| 41,664 | A | | 2/1864 | Hoadley | |
| 1,092,136 | A | | 4/1914 | Burchess | |
| 1,609,590 | A | | 12/1926 | Whidden | |
| 2,803,850 | A | | 8/1957 | Hooper | |
| 2,857,618 | A | | 10/1958 | Jordan | |
| 3,550,187 | A | * | 12/1970 | Swartz | 16/278 |
| 3,561,039 | A | | 2/1971 | Amrein | |
| 3,577,840 | A | * | 5/1971 | Buberniak | 16/332 |
| 3,629,899 | A | | 12/1971 | Deadrick | |
| 3,994,045 | A | * | 11/1976 | Roy | 16/355 |
| 4,050,117 | A | * | 9/1977 | Roy | 16/355 |
| 4,157,600 | A | * | 6/1979 | Thomas | 16/380 |
| 4,193,165 | A | | 3/1980 | Malacheski et al. | |
| 4,349,942 | A | * | 9/1982 | Roy | 16/376 |
| 4,850,082 | A | * | 7/1989 | Yi | 16/341 |
| 4,979,266 | A | * | 12/1990 | Roy | 16/376 |
| 5,455,989 | A | * | 10/1995 | Roy | 16/376 |
| 5,661,875 | A | | 9/1997 | Overcash et al. | |
| 5,898,976 | A | | 5/1999 | Leonardi, Sr. et al. | |
| 6,247,744 | B1 | | 6/2001 | Townsend et al. | |
| 6,557,810 | B2 | * | 5/2003 | Roy | 248/456 |
| 6,941,616 | B2 | * | 9/2005 | Roy | 16/254 |
| 7,051,404 | B2 | * | 5/2006 | Roy | 16/355 |
| 7,140,137 | B2 | | 11/2006 | Chang | |

FOREIGN PATENT DOCUMENTS

| | | |
|---|---|---|
| CA | 2065784 | 10/1993 |
| GB | 1295378 | 11/1972 |

OTHER PUBLICATIONS

Dirak Products, "HINGE", www.dirak.com.

* cited by examiner

*Primary Examiner* — William L. Miller
(74) *Attorney, Agent, or Firm* — Barlow, Josephs & Holmes, Ltd.

(57) ABSTRACT

A back closure for a multi-use frame includes a base plate and a lever. The base plate has a first and second knuckle. A tab is defined within the base plate between the first and second knuckle. The tab has spring-bias. A lever is connected to the base plate for movement relative to the base plate. The lever and the base plate have a common axis for movement relative to one another. The lever includes a center knuckle which is positioned between the first and second knuckle of the base plate. The center knuckle defining a slot for receipt of the tab to provide snap action. In operation, a user moves the lever relative to the base plate about a common axis. The tab of the base plate engages the slot defined within the lever to prevent further travel of the lever.

17 Claims, 14 Drawing Sheets

BACK CLOSURE

CROSS REFERENCE TO RELATED APPLICATIONS

This non-provisional patent application is related to and claims priority from earlier filed, U.S. Provisional Patent Application No. 61/105,193 filed Oct. 14, 2008, all of which is incorporated herein by reference.

BACKGROUND OF THE INVENTION

This invention relates generally to a closure and more particularly to a back closure having spring-bias and snap action for repetitive, predictable, and simple securing of a frame back to a multi-use frame.

Presently, there are many methods and devices for securing a frame back, which may or may not be hingedly connected to a multi-use frame, such as a turn button. For example, a turn button is used to maintain a frame back within a multi-use frame with media, such as a photograph or artwork, sandwiched therebetween. Prior art turn buttons are typically tab-like structures that are attached to a multi-use frame back or a multi-use frame. The tabs are pivotally attached to the multi-use frame back or multi-use frame so that they may pivot in place. The free ends of the turn button tabs, when in a locked position, reside within a groove in the frame back or multi-use frame to secure it in place. When pivoted to an open position, the tabs are no longer engaged with the frame back or multi-use frame so the frame back can be freely removed to gain access to an interior of the multi-use frame itself to insert or remove media therefrom.

In general, prior art turn buttons are typically attached to the multi-use frame back or multi-use frame by a rivet, a "built-in" eyelet, or simply punched therethrough. This attachment dictates the pivoting tension of the turn button itself. For example, a tightly secured rivet connection will result in a tight turn button making it very difficult to turn for the user of the frame. A less tightly secured rivet connection makes it easier to manipulate the turn button but the connection will also be loose making a poor locking connection and/or making it possible for the turn button to fall off of the frame back or multi-use frame completely.

Sometimes, the turn button may fail to reliably and predictably secure the frame back to the frame for a variety of reasons. On occasion, the frame back is made of material, such as soft cardboard, lacking sufficient strength to properly retain the turn button therein. Upon installation, the rivet may be improperly flared allowing the turn button to disengage. Also, a consumer may not properly place the turn button in the correct position to secure the frame back to the frame.

Therefore, there is a need for a repetitive, reliable, and predictable way of securing the frame back to the frame to prevent disengagement of the frame back from the frame. Also, there is a need for securing the frame back to the multi-use frame which is convenient and easy to use for a consumer.

BRIEF SUMMARY OF THE INVENTION

The present invention preserves the advantages of existing back closures while providing new advantages not found in currently available closures and overcoming many disadvantages of such currently available closures. The general concept of the present invention is to provide an improved back closure having spring-bias and snap action that provides a repetitive, reliable, and predictable way of securing a frame back to a multi-use frame to prevent disengagement of the frame back from the frame. In addition, the present invention provides a back closure for securing the frame back to the multi-use frame which is convenient and easy to use for a consumer.

The back closure for a multi-use frame includes a base plate and a lever. The base plate has a first and second knuckle. A spring-biased tab is defined within the base plate between the first and second knuckle. The base plate further includes an offset portion to allow the lever to move relative to the base plate with reduced or minimal interference from another object. The offset portion of the base plate defines at least two angled kerfs between the first and second knuckles to provide sufficient and desired spring-bias of the tab.

The tab has a bottom portion and a top portion. The bottom portion is integrally formed with an offset portion of the base plate. The bottom portion has a width approximately equal to a distance between at least two angled kerfs defined within the base plate. The bottom portion is tapered along its length. The top portion is integrally formed with the bottom portion. The top portion has a width equal to or less than the width of the slot. The top portion defines a mating formation for interfittingly mating the top portion with a mating formation defined within the slot. In one embodiment, the top portion defines a generally rectangular mating formation for receipt within a generally rectangular mating formation defined within the slot.

A lever is connected to the base plate for movement relative to the base plate. The lever has a curved portion at a distal end for manipulation by a user's fingers. The lever and the base plate have a common axis for movement relative to one another. In one embodiment, the lever is hingably or pivotally connected to the base plate by a hinge pin for movement by the common axis of rotation.

The lever includes a center knuckle which is positioned between the first and second knuckle of the base plate. The center knuckle defines a slot for receipt of the tab to provide snap action. The center knuckle has more than one surface area shape. The first surface area is an arcuate or rounded surface. The second surface area defines a ridge. The third surface area defines a flattened surface with the slot defined therein. In another embodiment, the center knuckle includes a stop structure for restricting the movement of the lever relative to the base plate.

A connection portion is provided for attaching the base plate to another object. In one embodiment, the connection portion is a rosette connection for attaching the base plate to another object. Also, the connection portion may be defined with the base plate opposite the tab. In one embodiment, the object may be a frame, multi-use frame, digital picture frame, picture frame, or frame for displaying important or sentimental documents, papers, or other materials. For example, a picture frame includes a front and rear portion of the frame and a frame back. The frame back is positioned within the rear portion of the frame. The base plate is attached to an outer periphery of the rear portion of the picture frame. The lever moves relative to the base plate to engage the frame back to secure it within the frame.

In operation, a user moves the lever relative to the base plate about a common axis to engage an object. The spring-biased tab of the base plate engages the slot defined within the lever under pressure to prevent further travel of the lever. When the tab is secured within the slot, the lever requires additional force by a user to dislodge the tab from the slot to further move the lever relative to the base plate.

It is therefore an object of the present invention to provide a closure with repetitive, predictable, and simple securing of a frame back to a multi-use frame.

It is a further object of the embodiment to provide a closure with a lever having spring-bias for snap-action.

Another object of the embodiment is to provide a closure with a base plate having a slot for engaging a tab having spring bias to prevent further travel of the lever.

Another object of the embodiment is to provide an offset portion of the base plate to facilitate movement of lever with minimal interference from another object.

Another object of the embodiment is to provide a connection portion of the base plate to firmly anchor the base plate within a multi-use frame.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the closure are set forth in the appended claims. However, the closure, together with further embodiments and attendant advantages, will be best understood by reference to the following detailed description taken in connection with the accompanying drawing Figures.

DETAILED DESCRIPTION OF THE PREFERRED EMBODIMENTS

Figure 11:
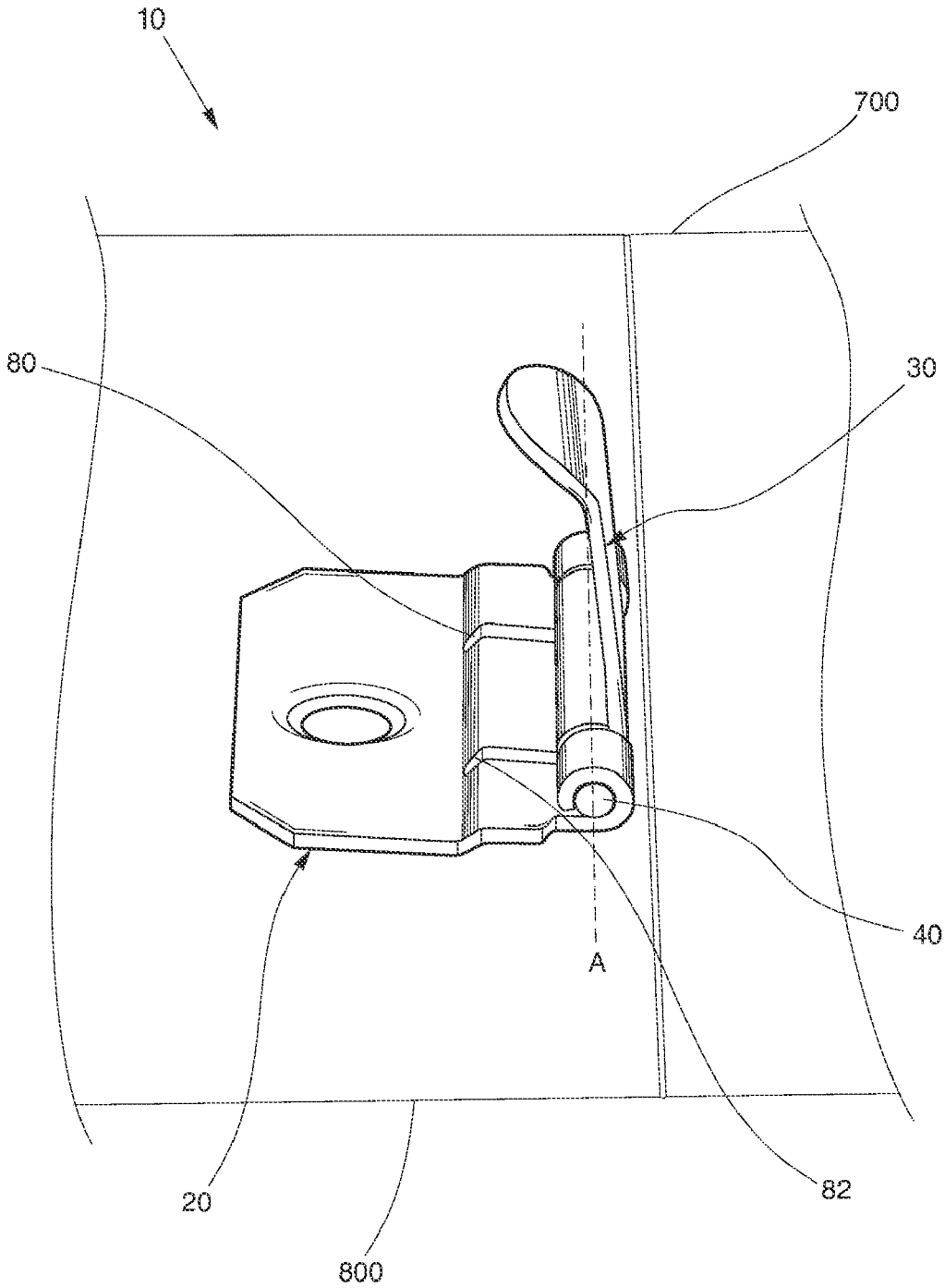
FIG. 11 is a side view of FIG. 1 with the lever in another open position and attached to a multi-use frame.
Figure 12:
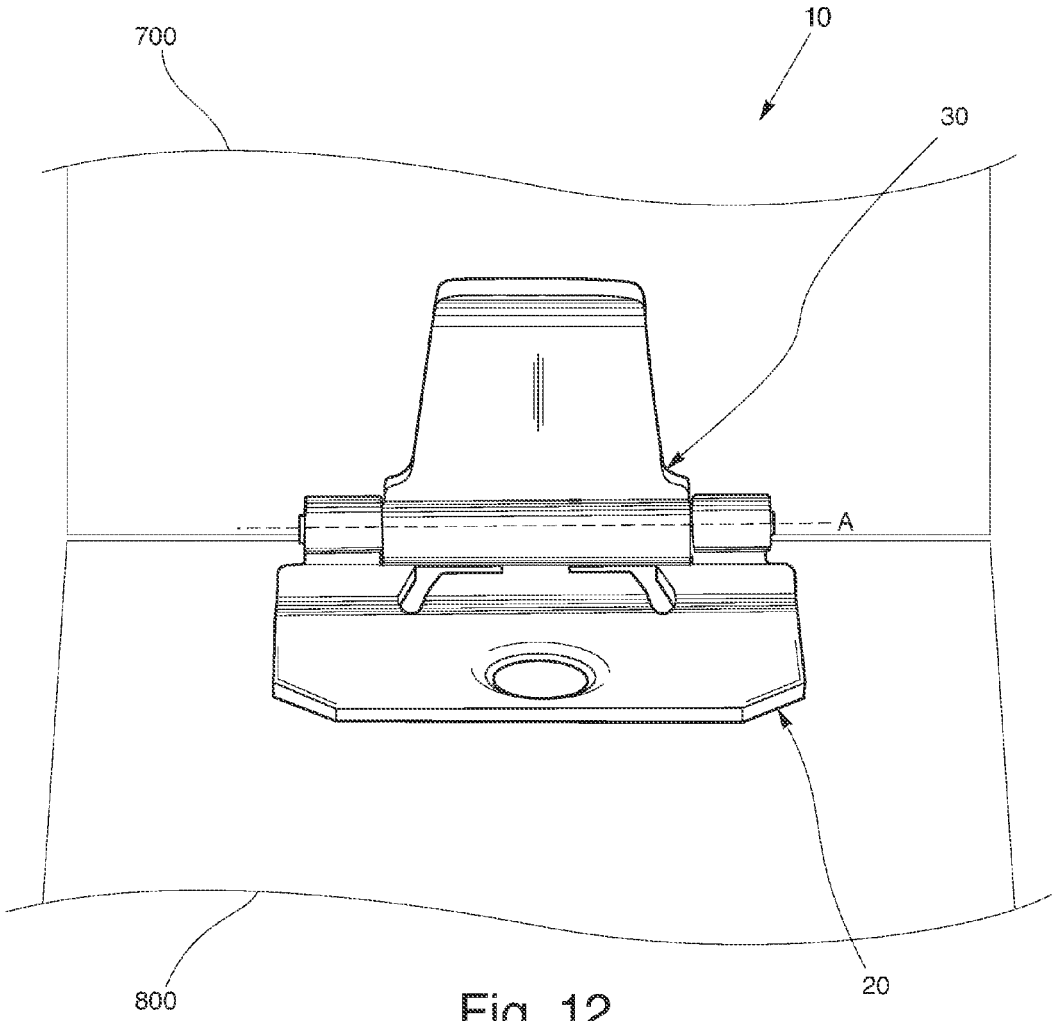
FIG. 12 is a rear view of FIG. 1 with the lever in another open position and attached to a multi-use frame.
Figure 13:
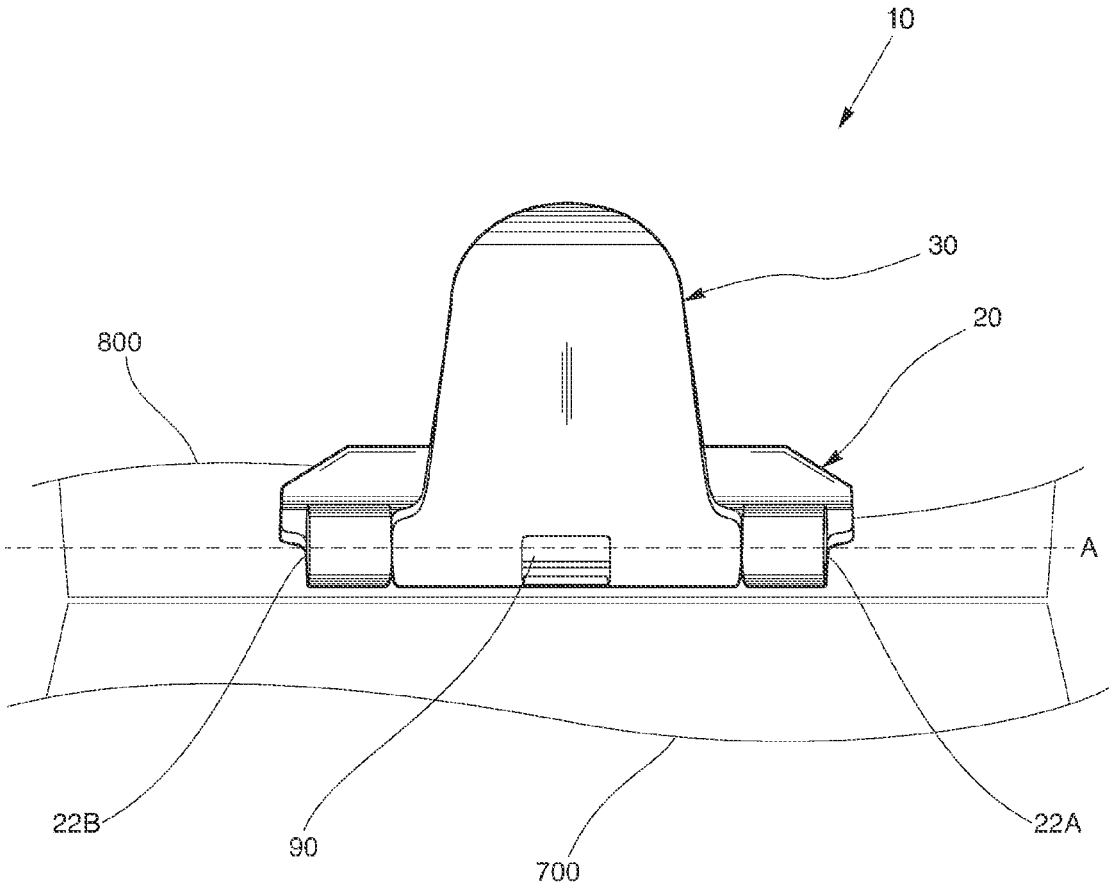
FIG. 13 is a front view of FIG. 1 with the lever in another open position and attached to a multi-use frame.
Figure 14:
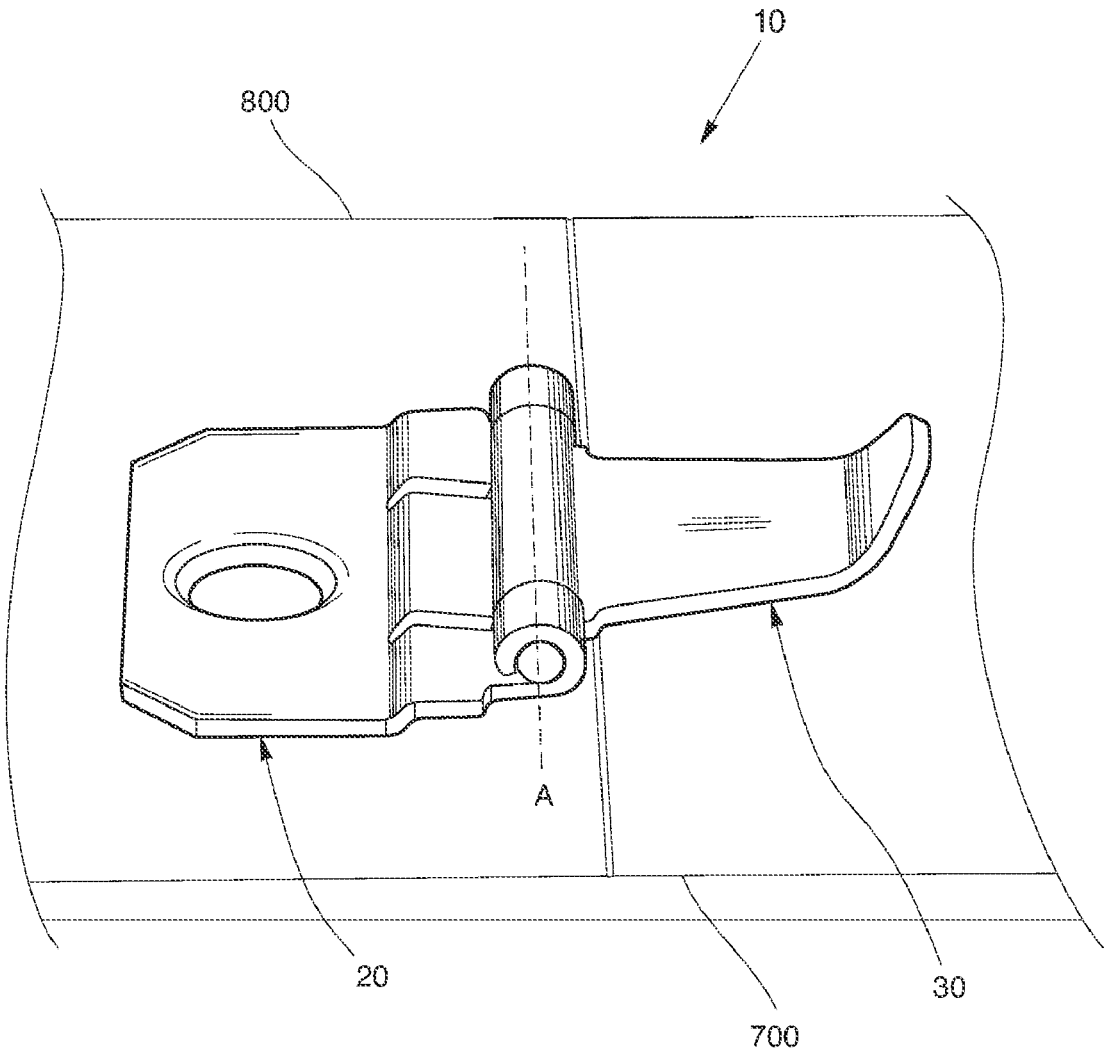
FIG. 14 is a side view of FIG. 1 with the lever in a fully closed position and attached to a multi-use frame.

Referring now to FIGS. 1-14, the back closure 10 of the instant invention is illustrated. Generally, the present invention provides an improved back closure 10 having spring-bias and snap action that provides a repetitive, reliable, and predictable way of securing a frame back 700 to a multi-use frame 800 to prevent disengagement of the frame back 700 from the multi-use frame 800. In addition, the back closure 10 secures the frame back 700 to the multi-use frame 800 which is convenient and easy to use for a consumer. Referring to FIG. 11, the closure 10 is attached to an outer peripheral edge of a rear portion of the multi-use frame 800. The closure 10 is in an open position which allows the frame back 700 to be moved away from the rear of the multi-use frame 800. Referring to FIG. 14, the closure 10 snaps or engages the frame back 700 to releasably secure the frame back 700 to the multi-use frame 800.

Figure 1:
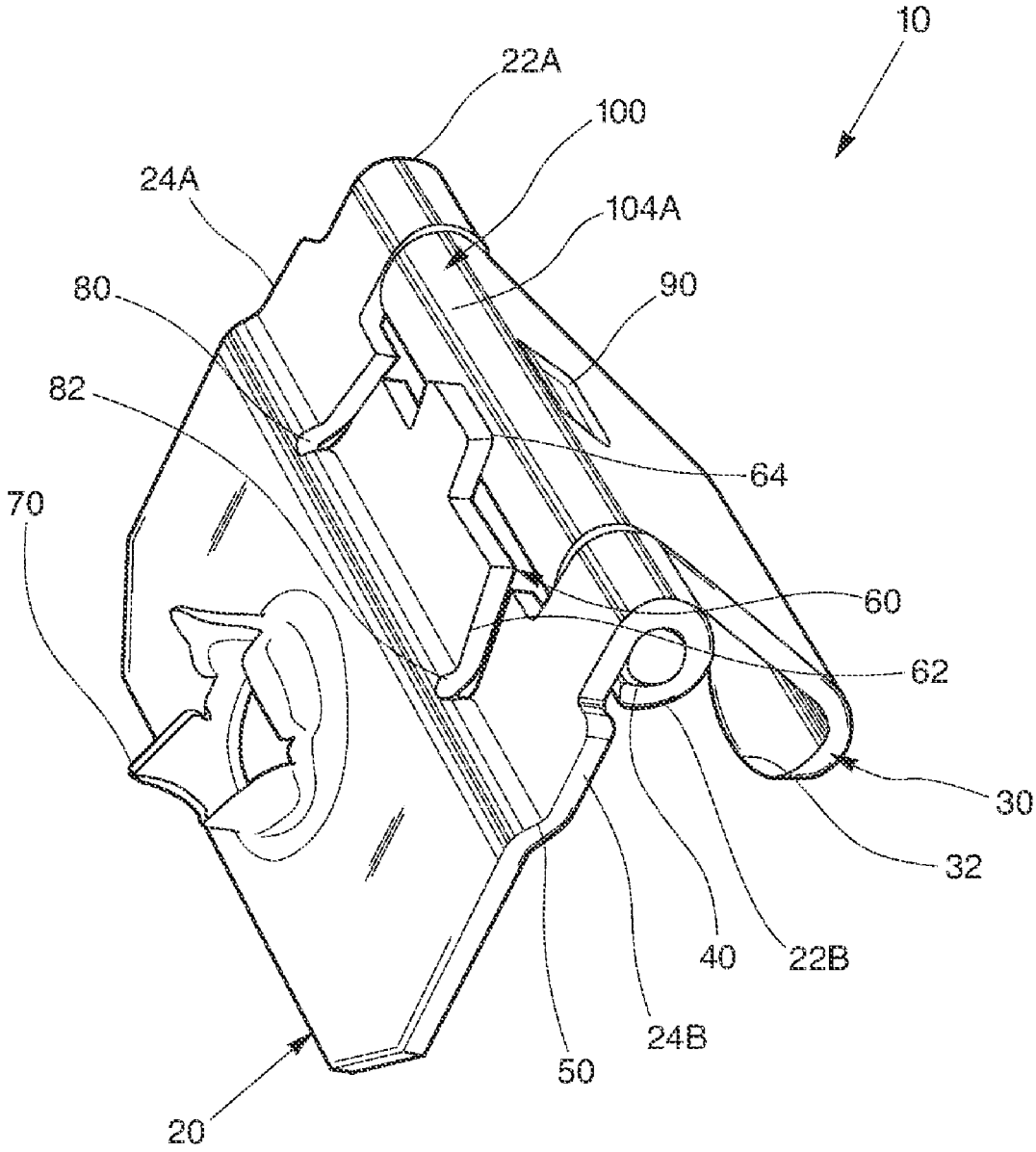
FIG. 1 is a bottom perspective view of the closure constructed in accordance with the teachings of the present invention.
Figure 2:
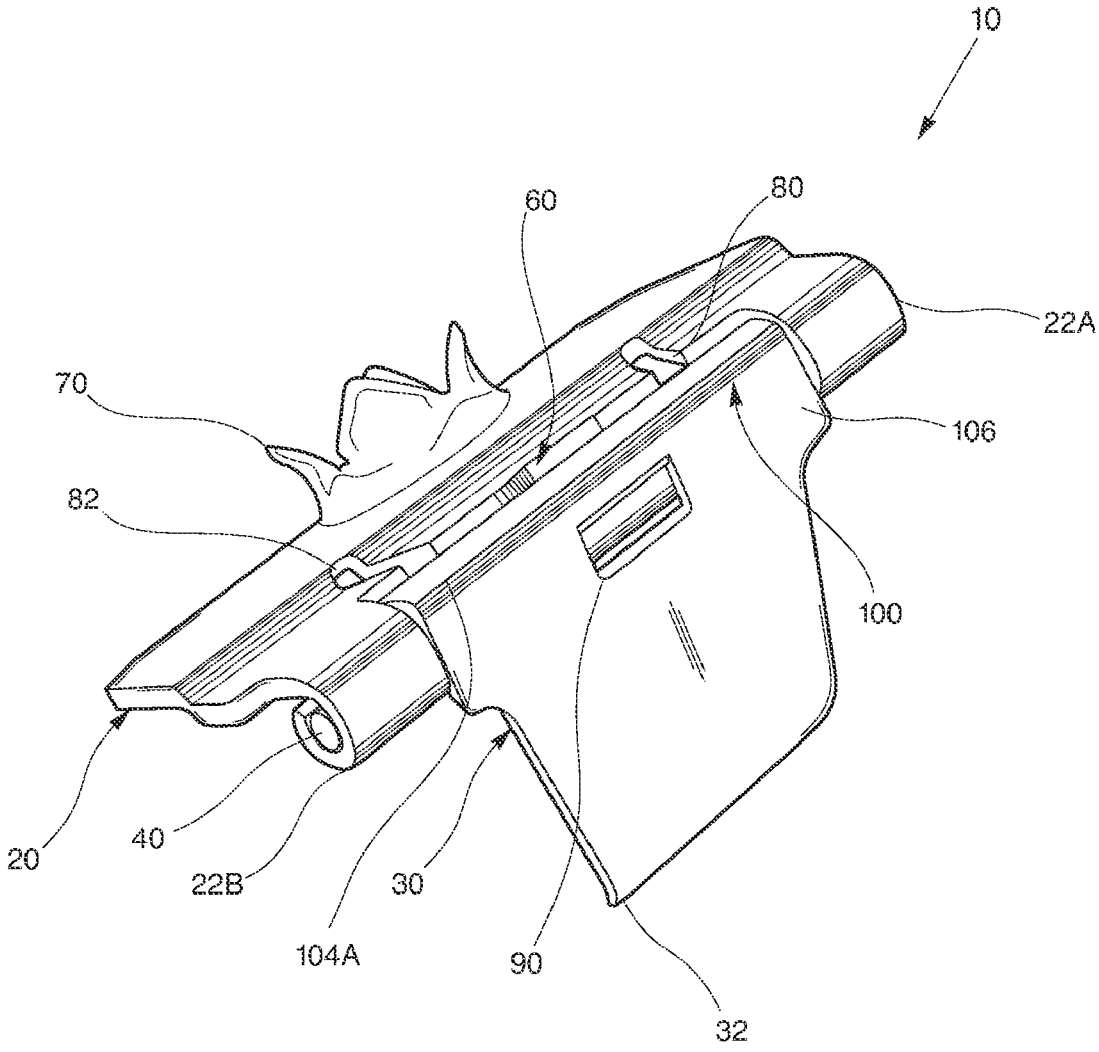
FIG. 2 is a front view thereof with the lever in an open position.

As illustrated in FIGS. 1-7, the closure 10 of the present invention is shown which is used for securing one object to another object, such as a frame back 700 to a multi-use frame 800. Referring to FIGS. 1-2, the back closure 10 for a multi-use frame 800 includes a base plate 20 and a lever 30. The base plate 20 has a first knuckle 22A and second knuckle 22B which are spaced apart at least a width of the lever 30. The first knuckle 22A and second knuckle 22B are essentially rolled about a hinge pin 40.

The base plate 20 further includes an offset portion 50 to allow the lever 30 to move relative to the base plate 20 with reduced or minimal interference from another object, such as a multi-use frame 800. The offset portion 50 allows the lever's motion relative to the rear portion of the frame 800. The offset portion 50 provides clearance for a tab 60 defined within the base plate 20 to move downwardly, during the movement of the lever 30, without engaging the rear portion of the frame 800. Without an offset portion, the tab 60 would engage the rear portion of the frame 800 which would result in the prying up and loosening of a connection portion 70, such as a rosette connection, from the rear portion of the frame 800.

The base portion 20 defines the tab 60 having spring-bias. The tab 60 has a bottom portion 62 and a top portion 64. The bottom portion 62 is integrally formed with the offset portion 50 of the base plate 20. The bottom portion 62 has a width approximately equal to a distance between at least two angled kerfs 80, 82 defined within the base plate 20. The bottom portion 62 is tapered along its length. The top portion 64 is integrally formed with the bottom portion 62. The top portion 64 has a width equal to or less than the width of a slot 90 defined within the lever 30. The top portion 64 defines a mating formation for interfittingly mating the top portion 64 with a mating formation defined within the slot 90. In one embodiment, the top portion 64 defines a generally rectangular mating formation for receipt within a generally rectangular mating formation defined within the slot 90.

The spring-bias of the tab 60 is adjustable according to the size, weight, and configuration of the multi-use frame 800 relative to the frame back 700 and according to the user's preference. At least two kerfs 80, 82 are defined within offset portion 50 of the base plate 20, between the first 22A and second knuckles 22B, to provide sufficient and desired spring-bias of the tab 60. In one embodiment, the kerfs 80, 82 are angled between a range of 0 and 180 degrees. In one embodiment the kerfs 80, 82 are angled at approximately 45 degrees. By increasing the angle of the kerfs 80, 82, a first and second side panel surface areas 24A, 24B increases to maintain the integrity of the knuckle connections 22A, 22B. The bottom portion 62 of the tab 60 remains wide thereby maintaining a high spring tension of the tab 60. By providing angled kerfs 80, 82, the needs of both a high tensioned tab and high integrity knuckle in connection can simultaneously be met.

The lever 30 is connected to the base plate 20 for movement relative to the base plate 20. The lever 30 has a curved portion 32 at a distal end for manipulation by a user's fingers. The lever 30 and the base plate 20 have a common axis A for movement relative to one another. In one embodiment, the lever 30 is hingably or pivotally connected to the base plate 20 by the hinge pin 40 for movement about the common axis A.

The lever 30 includes a center knuckle 100 which is positioned between the first 22A and second knuckle 22B of the base plate 20. The center knuckle 100 of the lever 30 fits between the first 22A and second knuckles 22B of the base 20 and is maintained in alignment with them by the hinge pin 40. Each knuckle 22A, 22B, 100 has defined a bore therein wherein the hinge pin 40 resides to hingedly connect the base plate 20 to the lever 30. The center knuckle 100 defines the slot 90 for receipt of the tab 60 to provide snap action.

In another embodiment, the center knuckle 100 includes a stop structure for restricting the movement of the lever 30 relative to the base plate 20. In one embodiment, a stop structure is defined within the center knuckle 100 to restrict movement of the lever 30 in the counterclockwise direction. Preferably, the stop structure prevents the movement of the lever 30 in the counterclockwise direction so that the lever 30, when in the "open position", is positioned at an upright angle or approximately 90 degrees.

Figure 6:
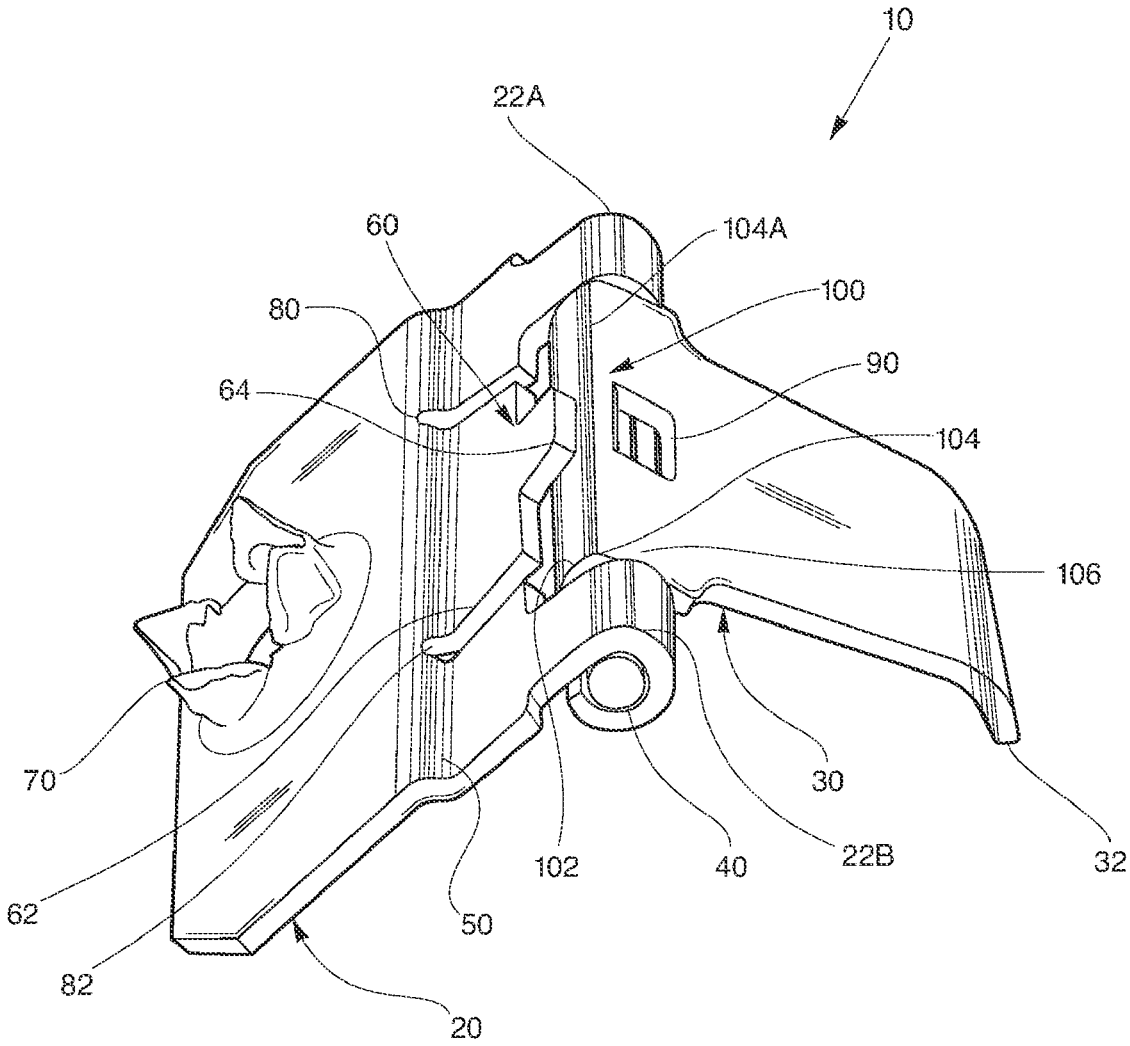
FIG. 6 is a side view thereof with the lever in an open position having a tab of the base plate engaging a ridge of the lever.

Referring to FIG. 6, the tab 60 of the base plate 20 engages the center knuckle 100 of the lever 30 during the movement of the lever 30 relative to the base plate 20. The center knuckle 100 has or defines more than one surface area. The first surface area 102 is an arcuate or rounded surface. The second surface area 104 defines a ridge 104A. The third surface area 106 defines a flattened surface with the slot 90 defined therein.

Figure 5:
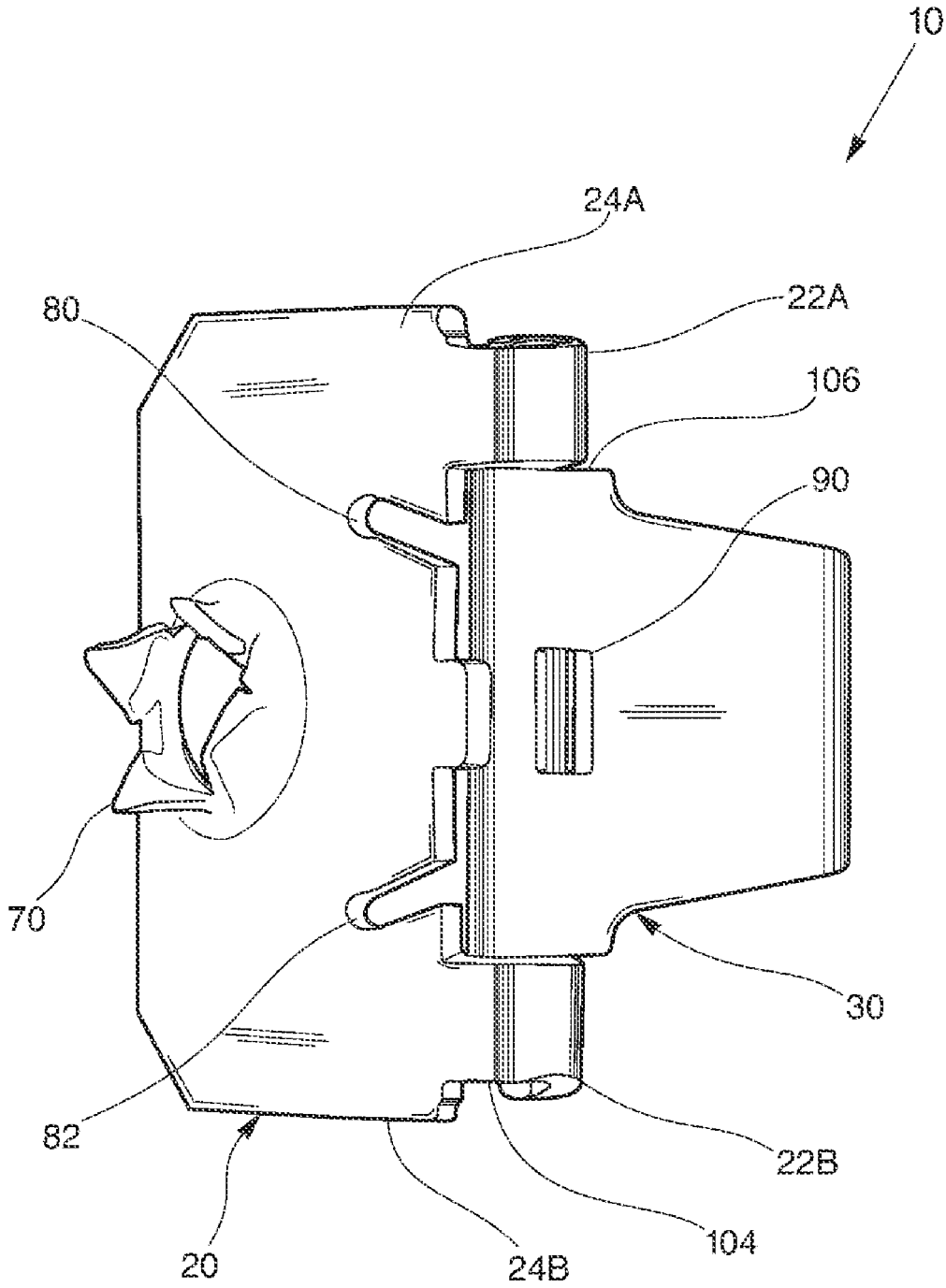
FIG. 5 is a bottom view thereof with the lever in an open position.
Figure 7:
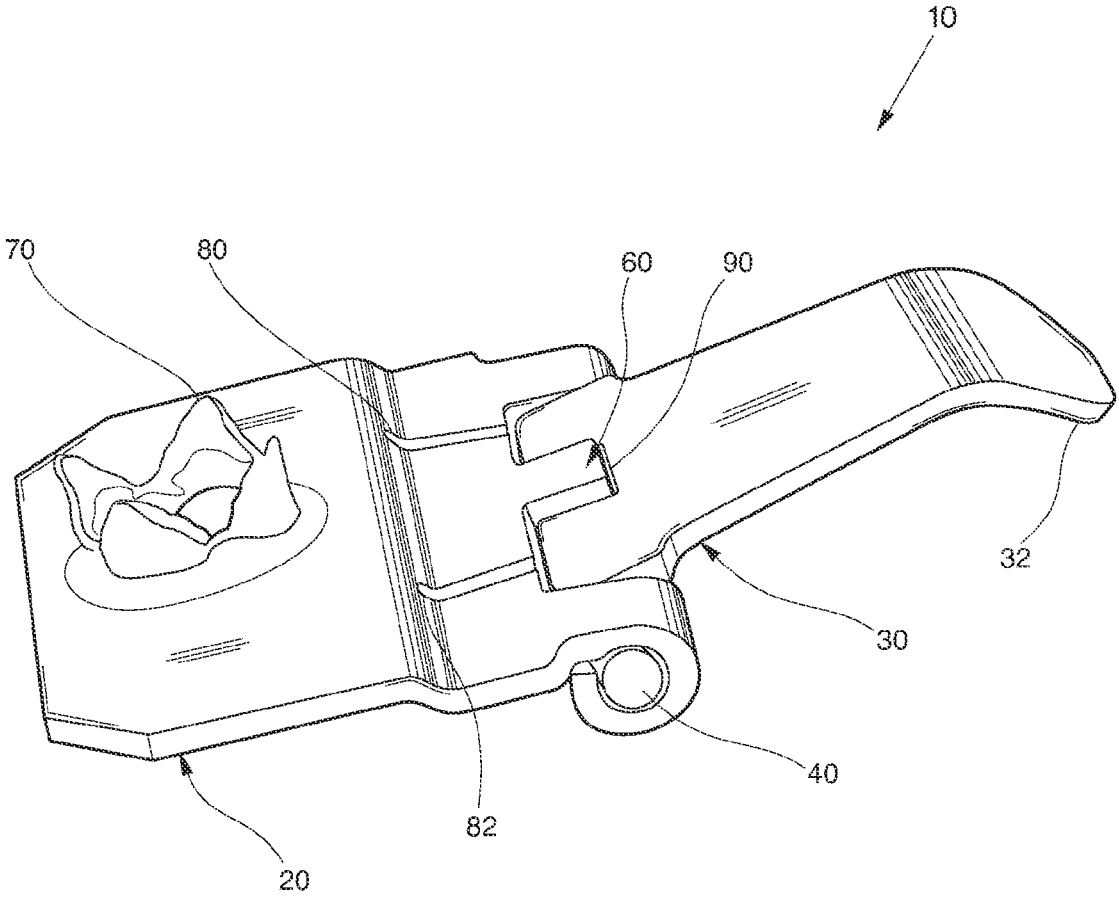
FIG. 7 is a side view thereof with the lever in a fully closed position.
Figure 8:
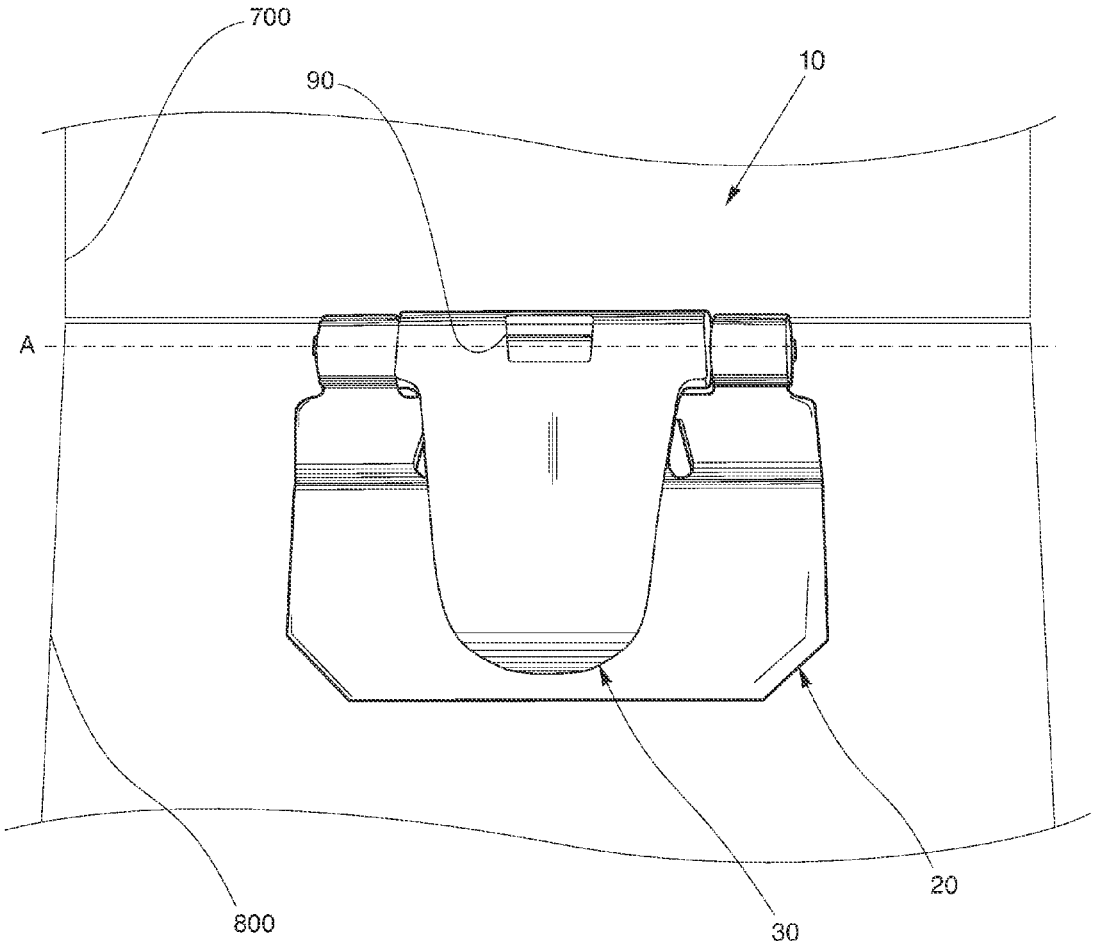
FIG. 8 is a top view of FIG. 1 with the lever in a fully open position and attached to a multi-use frame.
Figure 9:
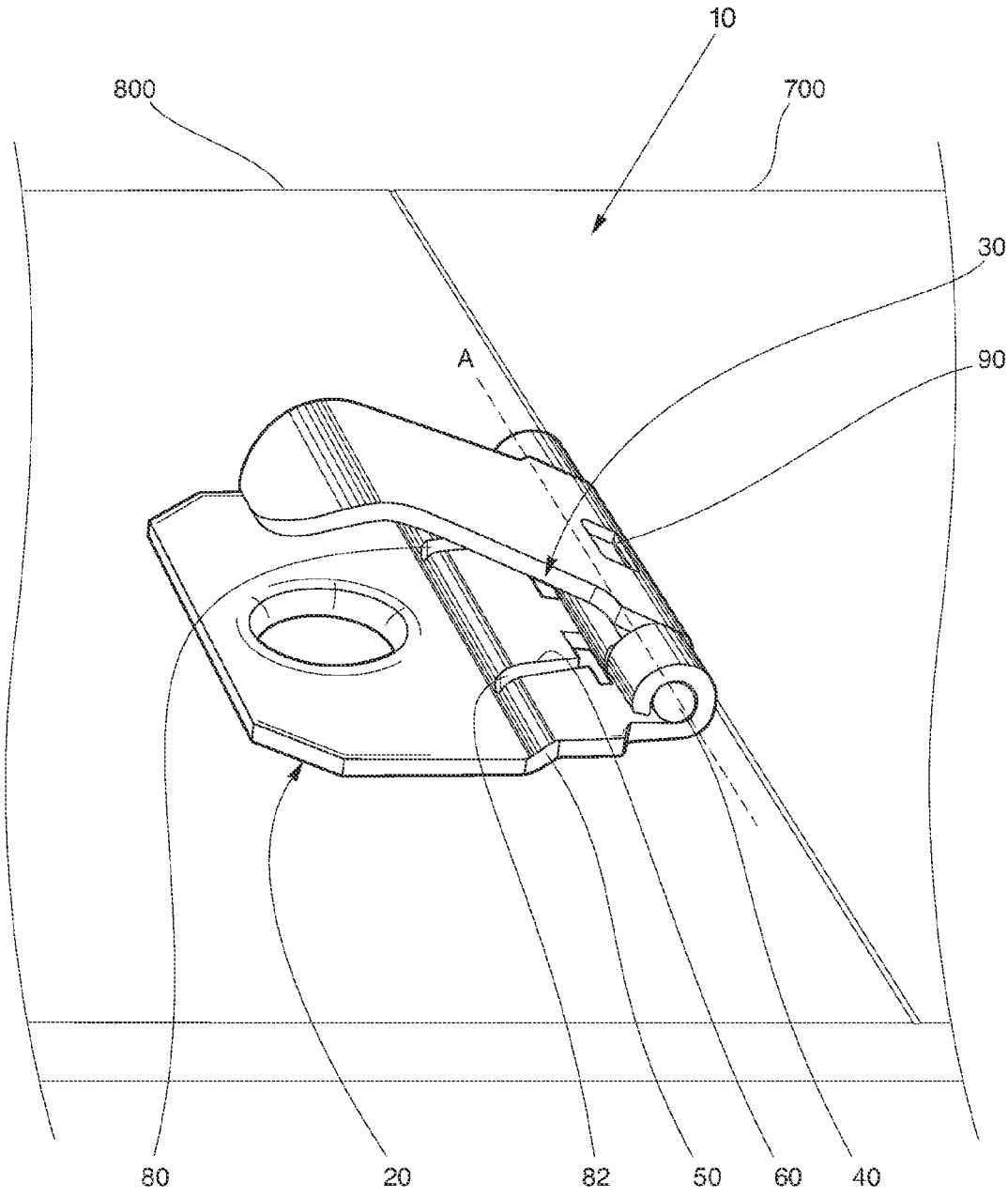
FIG. 9 is rear perspective view of FIG. 1 with the lever in an open position and attached to a multi-use frame.
Figure 10:
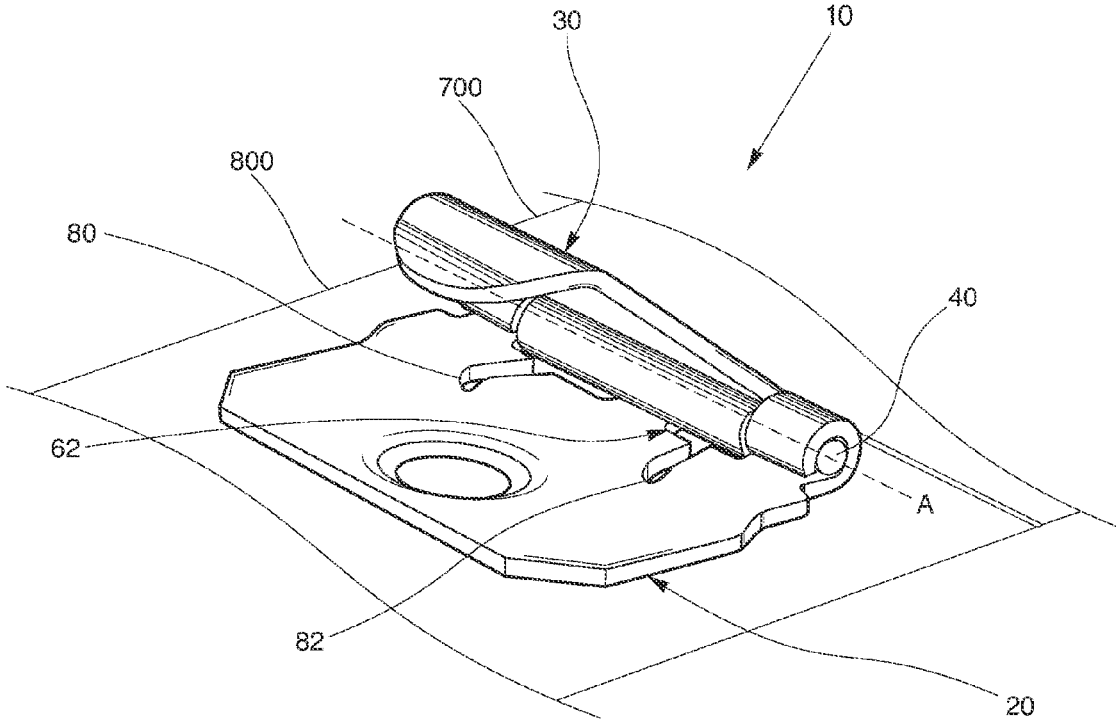
FIG. 10 is a rear perspective view of FIG. 1 with the lever in another open position and attached to a multi-use frame.

Referring to FIG. 5, when the tab 60 travels over the first surface area 102 of the center knuckle 100, the tab 60 maintains its original position and the lever moves easily about the hinge pin 40. Referring to FIG. 6, when the tab 60 contacts the ridge 104A on the second surface area 104, the movement of the lever 30 requires additional force by a user than required with movement over the first surface area 104. When additional force is applied to the lever 30, the tab 60 moves downwardly to travel over the ridge 104A. Due to the spring-bias of the tab 60, the tab 60 returns to its original position after traveling over the ridge 104A. Referring to FIG. 7, the tab 60 moves downwardly over the ridge 104A and snaps into the slot 90 defined within the third surface area 106 of the center knuckle 100. When the tab 60 is engaged within the slot 90, the lever 30 is in a "closed position" and prevented from any further movement in the clockwise direction. The tab 60, when in a closed position and residing in the slot 90, may be approximately 10-15 degrees below the horizontal axis of the base plate 20. This closed position of the tab 60 provides a pre-load of pressure to be overcome by a user before the lever 30 can be moved back into the open position.

A connection portion 70 is provided for attaching the base plate 20 to another object, such as a frame 800. In one embodiment, the connection portion 70 is an integrally formed rosette connection for attaching the base plate 20 to another object. Also, the connection portion 70 may be defined with the base plate 20 opposite the tab 60. The connection portion 70 contains a rosette connection or other means for connection known in the art for securing the closure 10 to a multi-use frame 800. In one embodiment, the rosette connection is affixed to a rear portion of the multi-use frame 800 flaring the ends of the rosette connection below a surface of the frame 800 to rigidly secure the closure 10 in place. Alternatively, the base plate 20 may also be rigidly affixed to the frame back 700 itself by methods or connections known in the art.

In one embodiment, the closure 10 is attached to an object. The object may be a frame, multi-use frame 800, digital picture frame, picture frame, or frame for displaying important or sentimental documents, papers, or other materials. For example, a picture frame includes a front and rear portion of the frame 800 and a frame back 700. The frame back 700 is positioned within the rear portion of the frame 800. The base plate 20 is attached to an outer periphery of the rear portion of the frame 800. The lever 30 moves relative to the base plate 20 to engage the frame back 700 to secure it within the frame 800.

In operation, as illustrated in FIGS. 8-14, the closure 10 is shown attached to an outer peripheral edge of a multi-use frame 800. The base plate 20 of the closure 10 is shown affixed to the frame 800 using a connection portion 70, preferably a rosette connection. FIGS. 8-13 show the lever 30 in a range of open positions which would allow a user to remove the frame back 700 from the multi-use frame 800 and remove any media therein, such as pictures. Preferably, the open position is where the lever 30 is in an upright position at approximately a 90 degree angle relative to the frame 800 as shown in FIG. 11. In the open position, the tab 60 is engaging the first surface area 102 of the center knuckle 100 of the lever 30 before the ridge 104A.

To move the lever 30 into the closed position, the user moves the lever 30 clockwise in the downward direction towards the frame back 700 with sufficient force. The force required by the user is sufficient for the tab 60 to move clockwise over the ridge 104A and snap into the slot 90 defined within the center knuckle 100. As shown in FIG. 14, the lever 30 is in a fully "closed position" whereby the lever 30 engages the frame back 700 of the frame 800. The lever 700 in a closed position secures the frame back 700 to the multi-use frame 800 to prevent the removal of the media contained therein, such as pictures or artwork.

To remove the frame back 700, the user lifts up the lever 30 in the counterclockwise direction with sufficient force. The force required is sufficient to move the tab 60 out of the slot 90, past the ridge 104A of the center knuckle 100, and over the first surface area 102 of the center knuckle 100. Note, a "door back" may also be used in conjunction with this closure 10 or any type of frame back 700 that is suitable for retaining media within the multi-use frame 800.

Figure 3:
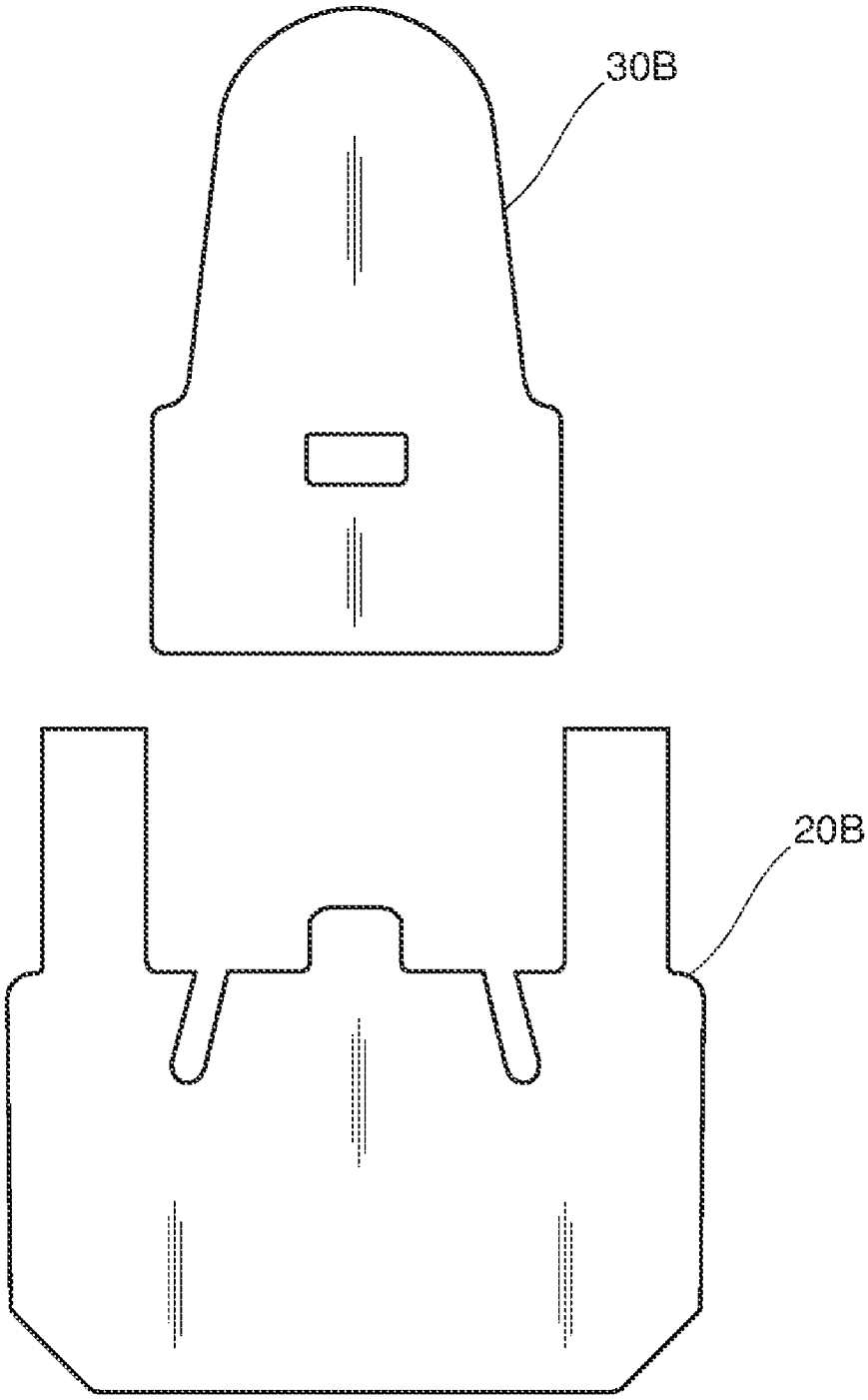
FIG. 3 is an exploded view of the lever and the base plate before construction into the invention of FIG. 1.
Figure 4:
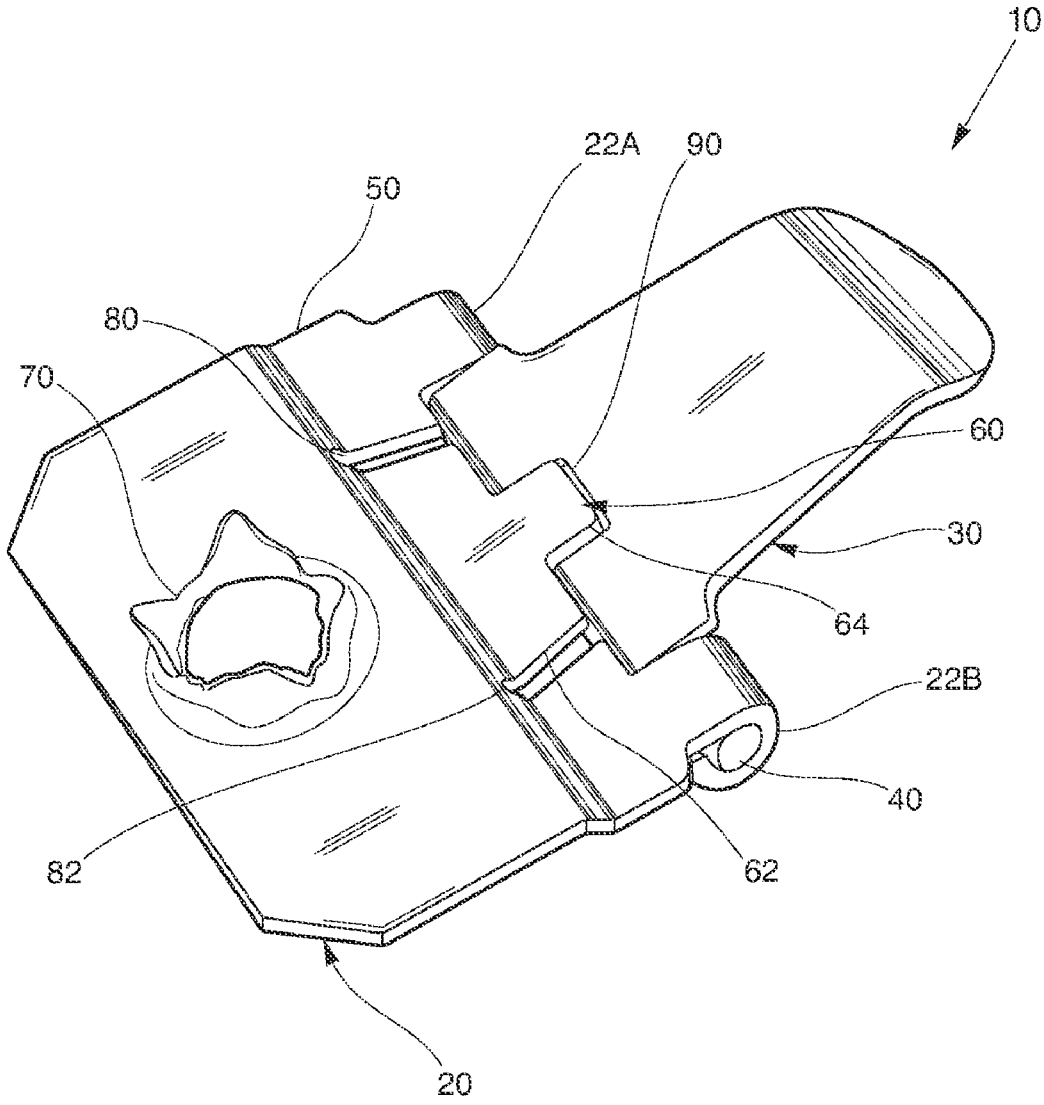
FIG. 4 is a bottom perspective view of FIG. 1 with the lever in a closed position.

Referring to FIG. 3, a stamped base plate 20B and a lever 30B in an unfinished format are used in construction of the closure 10. To facilitate the installation of the closure 10 on a multi-use frame 800 by machine, a carrying ribbon and carrying wire may be left in a strip of coil-feedable closures. By using both a ribbon and a wire, the closure 10 is allowed to be coiled into strip-fed application machinery which allows for automation of the application of the closure 10 to the frame 800. For example, the carrying wire is inserted through the bore of the knuckles 22A, 22B, 100 defined within the base plate 20 and lever 30. The carrying ribbon is attached to the base plate 20. During installation of the closure 10, the carrying ribbon and carrying wire provide greater stability and prevent twisting of the closure which facilitates smoother application of the closure 10 to a multi-use frame 800. At the appropriate time, the ribbon and wire are trimmed to leave the back closure 100 remaining.

In view of the foregoing, the present invention provides an improved back closure 100 having spring-bias and snap action for repetitive, predictable, and simple securing of a frame back 700 to a multi-use frame 800. Generally, in operation, a user moves the lever 30 relative to the base plate 20 about a common axis A to engage an object. The spring-biased tab 60 of the base plate 20 engages the slot 90 defined within the lever 30 under pressure to prevent further travel of the lever 30. When the tab 60 is secured within the slot 90, the lever 30 requires additional force by a user to dislodge the tab 60 from the slot 90 further move the lever 30 relative to the base plate 20.

It would be appreciated by those skilled in the art that various changes and modifications can be made to the illustrated embodiments without departing from the spirit of the present invention. All such modifications and changes are intended to be covered by the appended claims.

What is claimed is:

1. A closure, comprising:

a base plate having a first and second knuckle, a tab defined within said base plate between the first and second knuckle, said tab having spring-bias;

a lever connected to the base plate for movement relative to the base plate, said lever and said base plate having a common axis for movement relative to one another, the lever including a center knuckle between the first and second knuckle of the base plate, the center knuckle defining a slot for receipt of the tab to provide snap action; and the base plate includes an offset portion to allow the lever to move freely without interference from another object, when a user moves the lever relative to base plate about the common axis, the tab of the base plate engaging the slot defined within the lever to prevent further travel of the lever.

2. The closure of claim 1, wherein the center knuckle has an arcuate surface, a ridge, and a flattened surface with the slot defined therein.

3. The closure of claim 1, wherein the offset portion of the base plate defines at least two angled kerfs between the first and second knuckles to provide sufficient and desired spring-bias of the tab.

4. The closure of claim 1, further comprising:

a connection portion for attaching the base plate to said another object.

5. The closure of claim 4, wherein the connection portion is a rosette connection for attaching the base plate to said another object.

6. The closure of claim 4, wherein the connection portion is defined with the base plate opposite the tab.

7. The closure of claim 1, wherein the base plate is attached to said another object, wherein the another object is selected from a group consisting of: frame, multi-use frame, digital picture frame, picture frame, and frame for displaying documents.

8. The closure of claim 7, wherein the picture frame includes a front and rear portion of the frame and a frame back, the frame back positioned within the rear portion of the frame, said base plate is attached to the rear portion of the picture frame, the lever engages the frame back to secure it in place when the lever pivots relative to the base plate.

9. The closure of claim 1, wherein the tab has a bottom portion and a top portion.

10. The closure of claim 9, wherein said bottom portion is integrally formed with said offset portion of the base plate, said bottom portion having a width approximately equal to a distance between two angled kerfs defined within said base plate, wherein the offset portion of the base plate defines the two angled kerfs.

11. The closure of claim 10, wherein the bottom portion is tapered along its length.

12. The closure of claim 9, wherein the top portion is integrally formed with said bottom portion, said top portion having a width equal to or less than the width of the slot, said top portion defining a mating formation for interfittingly mating said top portion with a mating formation defined within said slot.

13. The closure of claim 12 wherein the top portion defines a generally rectangular mating formation for receipt within a generally rectangular mating formation defined within said slot.

14. The closure of claim 1, wherein the lever is hingably connected to the base plate for pivotal movement about the common axis.

15. The closure of claim 1, wherein the lever is pivotally connected to the base for pivotal movement about the common axis.

16. A closure for a picture frame, comprising:

a base plate having a first and second knuckle, a tab defined within said base plate between the first and second knuckle, said tab having spring-bias;

a lever connected to the base plate for movement relative to the base plate, said lever and said base plate having a common axis for movement relative to one another, the lever including a center knuckle between the first and second knuckle of the base plate, the center knuckle defining a slot for receipt of the tab to provide snap action;

the base plate attached to a picture frame, the picture frame includes a front and rear portion of the frame and a frame back, the frame back positioned within the rear portion of the frame, said base plate is attached to the rear portion of the picture frame, the lever engages the frame back to secure it in place when the lever pivots relative to the base plate; and when a user moves the lever relative to base plate about the common axis, the tab of the base plate engaging the slot defined within the lever to prevent further travel of the lever.

17. A closure, comprising:

a base plate having a first and second knuckle, a tab defined within said base plate between the first and second knuckle, said tab having spring-bias;

a lever connected to the base plate for movement relative to the base plate, said lever and said base plate having a common axis for movement relative to one another, the lever including a center knuckle between the first and second knuckle of the base plate, the center knuckle defining a slot for receipt of the tab to provide snap action;

a connection portion for attaching the base plate to another object, the connection portion is a rosette connection for attaching the base plate to said another object; and when a user moves the lever relative to base plate about the common axis, the tab of the base plate engaging the slot defined within the lever to prevent further travel of the lever.

* * * * *